United States Patent [19]

Folland

[11] 4,306,816

[45] Dec. 22, 1981

[54] BARODYNAMIC RESONATOR

[75] Inventor: Roy E. Folland, Westmount, Canada

[73] Assignee: Folland Corporation, Coral Gables, Fla.

[21] Appl. No.: 137,271

[22] Filed: Apr. 4, 1980

[51] Int. Cl.[3] ..... B01F 11/00

[52] U.S. Cl. ..... 366/119; 366/600

[58] Field of Search ..... 366/119, 114, 116, 117, 366/118, 600

[56] References Cited

U.S. PATENT DOCUMENTS

| | | | |
|---|---|---|---|
| 3,614,069 | 10/1971 | Murry | 366/119 |
| 3,658,302 | 4/1972 | Duthion | 366/119 |
| 3,809,372 | 5/1974 | Duthion | 366/119 |
| 4,129,387 | 12/1978 | Grange | 366/119 |

*Primary Examiner*—Edward J. McCarthy
*Attorney, Agent, or Firm*—Oblon, Fisher, Spivak, McClelland & Maier

[57] ABSTRACT

A barodynamic resonator for cavitating water in a liquid mixture to form a stable emulsion. The resonator comprises a resonator body defining a chamber therein. A resonant element is adjustably supported in the chamber. An inlet nozzle admits the mixture under pressure within the chamber to form a hollow spray pattern that impinges on the resonant element to cause the resonant element to resonate at a frequency sufficient to cause the water to cavitate into finer water globules to form a stable emulsion. An outlet port is provided in the body and communicates with the chamber to provide for the outflow of the stable emulsion therefrom.

8 Claims, 1 Drawing Figure

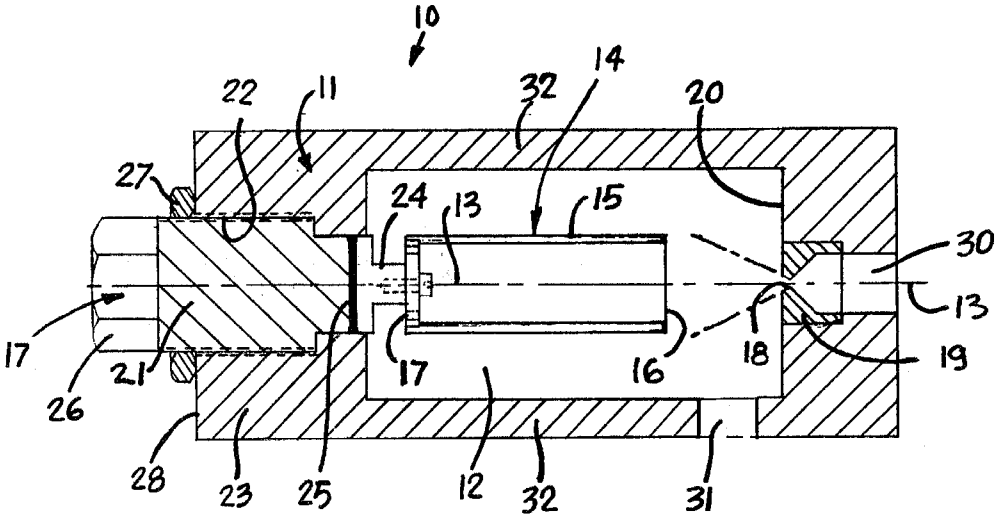
10
11
12
13
14
15
16
17
18
19
20
21
22
23
24
25
26
27
28
30
31
32

BARODYNAMIC RESONATOR

BACKGROUND OF INVENTION (a) Field of Invention

The present invention relates to a barodynamic resonator for cavitating water in a liquid mixture to form a stable emulsion.

(b) Description of Prior Art

Various types of ultrasonic resonators are known wherein an element is vibrated by an electrical circuit and placed in a chamber containing a liquid mixture whereby to cause the mixture to break down in smaller liquid globules to improve the emulsion state thereof. These known devices are complex in structure, therefore expensive to fabricate, and require very fine adjustment.

SUMMARY OF INVENTION

It is a feature of the present invention to provide a barodynamic resonator which is an improvement over known prior art devices which causes cavitation in the water contained in the liquid mixture.

Another feature of the present invention is to provide a barodynamic resonator wherein the resonating element is caused to resonate by a pressure stream of the liquid mixture impinged thereupon.

Another feature of the present invention is to provide a barodynamic resonator which is simple in construction and easy to calibrate.

A further feature of the present invention is to provide an improved method of emulsifying a liquid mixture containing water by directing a flow of the liquid mixture under pressure against a resonating element to cause it to resonate and thereby cause cavitation of the water.

According to the above features, from a broad aspect, the present invention provides a barodynamic resonator for cavitating water in a liquid mixture to form a stable emulsion. The resonator comprises a resonator body defining a chamber therein. A resonant element is adjustably supported in the chamber. Inlet means is provided to admit the mixture in the chamber to impinge on the resonant element to cause the resonant element to resonate at a frequency sufficient to cause the water to cavitate into finer water globules to form the stable emulsion. An outlet is provided in the body and communicates with the chamber for the outflow of the stable emulsion therefrom.

According to a further broad aspect of the present invention there is provided a method of emulsifying a liquid mixture containing water. The method comprises the steps of providing the liquid mixture under a pressure of at least 100 PSIG. A flow of the pressurized liquid mixture is then directed against the resonant element supported in a chamber to cause the resonant element to resonate at a frequency sufficient to cause the water to cavitate into finer water globules to form a stable emulsion. The stable emulsion is then directed out of the chamber.

DESCRIPTION OF PREFERRED EMBODIMENTS

A preferred embodiment of the present invention will now be described with reference to the example thereof illustrated in the accompanying in which:

the FIGURE is a section view of the barodynamic resonator.

The barodynamic resonator is generally shown at 10 and it comprises a resonator body 11 defining a chamber 12 therein. As herein shown the body 11 is an elongated cylindrical shape body having a chamber 12 of the same shape and aligned concentrically therein on the same central longitudinal axis 13. A resonant element 14 is supported concentrically within the chamber 12.

The resonant element as herein shown is formed of an elongated light gauge cylindrical steel tube defining a continuous side wall 15 having an open end 16 and an opposed securement end 17. The securement end 17 is connected to an adjustment means 18 whereby the spacing between the open end 16 of the resonant element 14 is adjustable with respect to a jet orifice 18 of an inlet nozzle 19 secured in end wall 20 of the chamber 12 and coaxially aligned with the central longitudinal axis 13.

The adjustment means 18 is constituted by an axially threaded bolt-like element 21 threadably displaceable in a threaded bore 22 provided in the end wall 23 of the body 11. The bolt-like element 21 is coaxially disposed with respect to the central longitudinal axis 13 and has a securement free end 24 attachable to the securement end wall 17 of the resonant element 14. An O-ring seal 25 is provided about a portion of the bolt-like element to provide a leak-proof seal and an adjuster nut 26 is provided at an outer end of the bolt-like element 21 and may have calibration markings (not shown) to indicate a certain position of the spacing between the open end 16 and the end wall 20 of the chamber 12. A lock nut 27 is threaded on the bolt-like element 21 and against the outer wall 28 of the body 11 to lock the bolt-like element 21 in a desired position.

An inlet connection (not shown) connects to the inlet port 30 of the body 11 and directs a liquid mixture containing water to the inlet nozzle 19. This water mixture is herein a water/oil mixture under a pressure of at least 100 PSIG. The jet orifice 18 of the nozzle 19 is selected whereby the water/oil mixture will be injected into the chamber in a hollow spray pattern having an included angle of about 70 degrees. As can be seen, the injected spray will impinge on the cylindrical steel tube from the open end 16. The impingement of this liquid under pressure will cause the tube to resonate at a frequency, generally above 10,000 Hz/sec. This resonance of the tube will be of sufficient frequency to cause the water in the fluid in contact with it to cavitate and break down into finer water globules. The resulting emulsion, due to the fineness of the water therewithin, is found to be extremely stable and has not been inclined to break down or separate.

An outlet port 31 is provided in a side wall 32 of the body 11 and communicates with the chamber 12 whereby a suitable connection (not shown) may be connected thereto to provide for the outflow of the stable emulsion from the chamber 12. Although not shown, sensing means is provided to detect the frequency of the resonant element 14. This is desired to tune the resonant element to its resonant frequency and this is achieved by rotating the adjuster nut 26 until this resonant frequency is sensed. This sensing means may be a transducer connected to a suitable meter and permanently or temporarily installed into a connection into the wall 32 of the chamber 12. Also, a standard industrial stethoscope may be used. A disc-type sensor could be placed on the side of the chamber, or a pencil-type sensor may be inserted into a hole drilled part-way through the wall 32 of the chamber, to sense the frequency of the resonant element 14.

As shown in the example of the preferred embodiment, the length of the cylindrical side wall 15 is at least twice the length of the diameter of the open end 16. However, the resonator may be constructed differently and with different length ratios. The adjustment means 17 may also be of different construction and the particular included angle of the spray pattern need not be limited to the above-described angle. It is therefore within the ambit of the present invention to cover any obvious modification of the example of the preferred embodiment described herein, provided such modifications fall within the scope of the appended claims.

I claim:

1. A barodynamic resonator for cavitating water in a liquid mixture to form a stable emulsion, said resonator comprising a resonator body defining a chamber therein; a resonant drum adjustably supported in said chamber, inlet means to admit said mixture in said chamber to impinge on said resonant drum to cause said resonant drum to resonate at a frequency sufficient to cause said water to cavitate into finer water globules to form said stable emulsion, said drum having a continuous side wall, an open end and an opposed securement end; said securement end being connected to an adjustment means to adjust the position of said resonant drum with respect to said inlet means, and an outlet in said body communicating with said chamber for the outflow of said stable emulsion therefrom.

2. A barodynamic resonator as claimed in claim 1 wherein said continuous side wall is an elongated light gauge cylindrical steel tube which is at least twice the length of the diameter of said open end.

3. A barodynamic resonator as claimed in claim 1 wherein said inlet means is an inlet nozzle, said nozzle having a jet orifice aligned with substantially the center of said open end of said resonant drum.

4. A barodynamic resonator as claimed in claim 3 wherein said jet orifice causes said liquid mixture to be sprayed within said chamber in a hollow spray pattern at an included angle of about 70 degrees and at a pressure of at least 100 PSIG.

5. A barodynamic resonator as claimed in claim 1 wherein said adjustment means is an axially displaceable element extending through a wall portion of said resonator body and secured at one end to said securement end of said resonant drum, engagement means at an opposed end of said displaceable element for adjusting said position of said resonant drum and sensing means to detect the frequency of said resonant drum.

6. A barodynamic resonator as claimed in claim 5 wherein said axially displaceable element is a threaded bolt-like element having its central longitudinal axis coaxially aligned with the central longitudinal axis of said continuous side wall and the center of said inlet means.

7. A barodynamic resonator as claimed in claim 1 wherein said outlet is a through bore in a wall of said resonator body located in a lower portion thereof to cause outflow of said stable emulsion.

8. A method of emulsifying a liquid mixture containing water comprising the steps of:

(i) providing said liquid mixture under a pressure of at least 100 PSIG, (ii) directing a flow of said pressurized liquid mixture against a resonant drum supported in a chamber to cause said resonant drum to resonate at a frequency sufficient to cause said water to cavitate into finer water globules to form a stable emulsion, said flow of said liquid mixture being passed through an inlet nozzle having a jet orifice to cause said mixture to be sprayed within said chamber in a hollow spray pattern against an open end of said resonant drum which is an elongated light gauge cylindrical steel tube, (iii) sensing the resonant frequency of said steel tube, (iv) adjusting the position of said steel tube to adjust the resonant frequency thereof, and (v) directing said stable emulsion out of said chamber.

* * * * *